United States Patent [19]

Collins

[11] Patent Number: 4,473,256

[45] Date of Patent: Sep. 25, 1984

[54] CHISEL BARGE WITH SHOCK ABSORBING SYSTEM FOR MAST

[75] Inventor: James G. Collins, South Haven, Mich.

[73] Assignee: Canonie, Inc., Muskegon, Mich.

[21] Appl. No.: 458,814

[22] Filed: Jan. 18, 1983

[51] Int. Cl.[3] ..... E21C 33/00; E21C 37/26

[52] U.S. Cl. ..... 299/37; 173/28; 173/84

[58] Field of Search ..... 299/37; 175/5; 173/28, 173/84; 37/73

[56] References Cited

U.S. PATENT DOCUMENTS

| | | | |
|---|---|---|---|
| 517,556 | 4/1894 | Ross | 37/73 |
| 874,217 | 12/1907 | Lobnitz | 175/5 X |
| 1,169,396 | 1/1916 | Groves | 37/73 |
| 1,265,494 | 5/1918 | Packard | 37/73 X |
| 1,596,341 | 8/1926 | Dormoy | 175/5 X |

FOREIGN PATENT DOCUMENTS

| | | | |
|---|---|---|---|
| 657328 | 2/1938 | Fed. Rep. of Germany | 299/37 |
| 240544 | 3/1969 | U.S.S.R. | 37/73 |

*Primary Examiner*—Ernest R. Purser

*Attorney, Agent, or Firm*—Flynn, Thiel, Boutell & Tanis

[57] ABSTRACT

A chisel barge having an elongated hull floatable on a body of water with positioning means thereon maintaining the position of the hull in a generally fixed location while in a floating condition spaced from land. Bracket structure is provided on the hull, which bracket construction has an opening therethrough, the axis of which is inclined to the horizontal. Structure for pivotally supporting the bracket structure is provided on the hull to enable the bracket structure to pivot about a generally horizontal axis. An upstanding mast is mounted on the bracket structure and is tiltably movable therewith about the aforesaid generally horizontal axis. A chisel having a tool-like structure located at the lower end thereof is vertically movably mounted on the mast and through the opening. A control circuit is provided for effecting a hoisting of the chisel to a raised position on the mast spaced from the bottom of the aforesaid body of water and for effecting a free fall of the chisel to a lowered position to impact and effect a working of the bottom of the aforesaid body of water.

10 Claims, 17 Drawing Figures

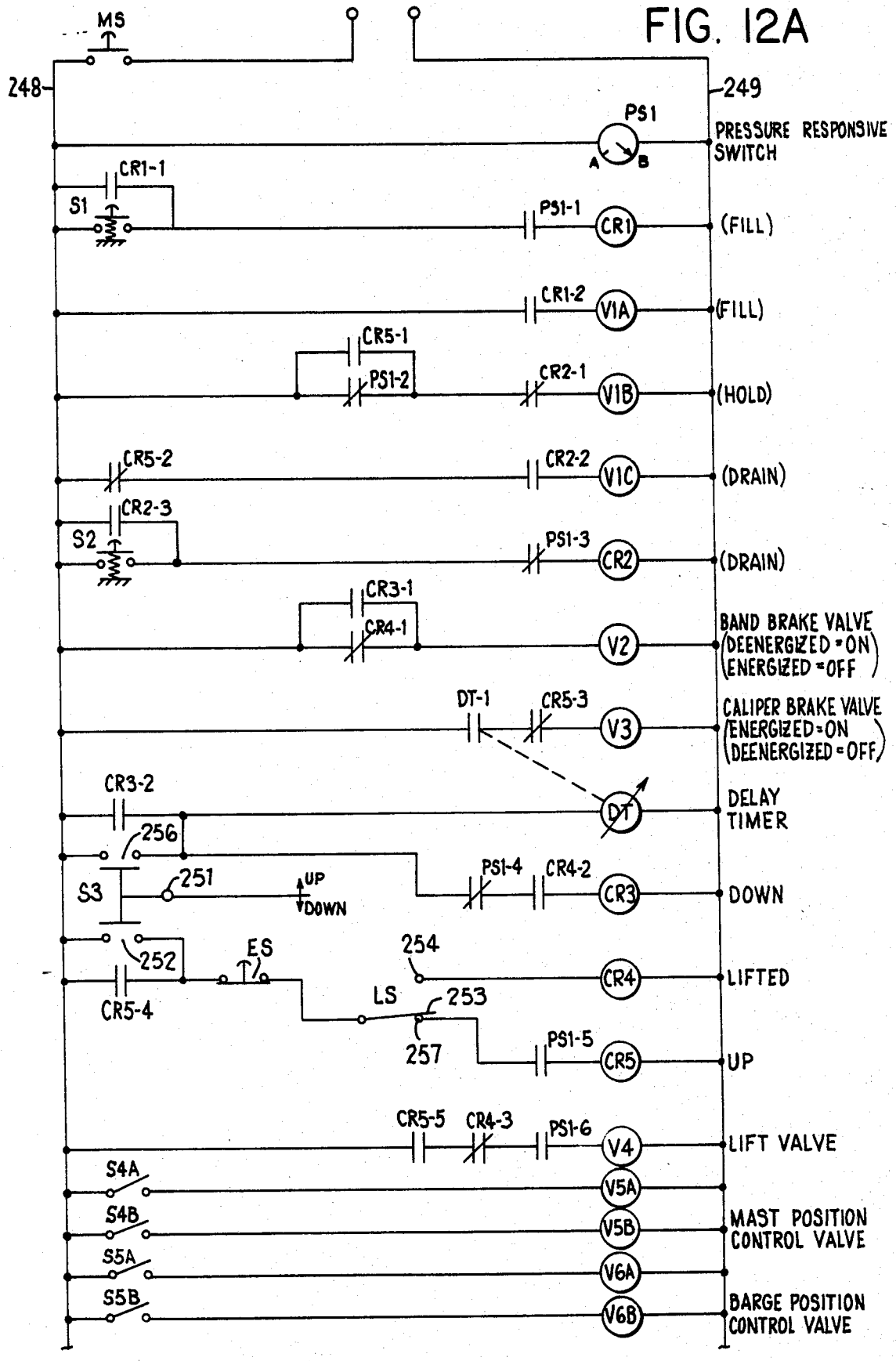
FIG. 12A
MS
248
249
PS1
A
B
PRESSURE RESPONSIVE SWITCH
CR1-1
S1
PS1-1
CR1
(FILL)
CR1-2
V1A
(FILL)
CR5-1
PS1-2
CR2-1
V1B
(HOLD)
CR5-2
CR2-2
V1C
(DRAIN)
CR2-3
S2
PS1-3
CR2
(DRAIN)
CR3-1
CR4-1
V2
BAND BRAKE VALVE (DEENERGIZED = ON ENERGIZED = OFF)
DT-1
CR5-3
V3
CALIPER BRAKE VALVE (ENERGIZED = ON DEENERGIZED = OFF)
CR3-2
DT
DELAY TIMER
256
S3
251
UP
DOWN
PS1-4
CR4-2
CR3
DOWN
252
ES
254
CR4
LIFTED
CR5-4
LS
253
257
PS1-5
CR5
UP
CR5-5
CR4-3
PS1-6
V4
LIFT VALVE
S4A
V5A
S4B
V5B
MAST POSITION CONTROL VALVE
S5A
V6A
S5B
V6B
BARGE POSITION CONTROL VALVE

CHISEL BARGE WITH SHOCK ABSORBING SYSTEM FOR MAST

FIELD OF THE INVENTION

This invention relates to a floating barge and, more particularly, to a chisel barge having at least one vertically elevatable chisel mounted thereon and capable of free falling to engagement with the bottom of a body of water to impart work thereon.

BACKGROUND OF THE INVENTION

A need has arisen to deepen many harbors to enable the harbors to accommodate large ships. In many cases the effort to deepen a channel, for example, necessitates the removal of rock from the bottom. Heretofore, blasting techniques have been utilized. However, blasting techniques are extremely expensive in view of the fact that the Environmental Protection Agency requires that the vibrations from such blasting be monitored at many locations around the blasting site as well as the sound produced thereby be monitored. In addition, the Department of Natural Resources has objected to the use of blasting techniques due to the large amounts of marine life that are killed during such under water blasting operations. Thus, blasting operations are generally performed during limited periods of time during the year when certain species of marine life are not present in the channel or harbor. In many instances, the rock removal operation cannot be accomplished within the limited time frame offered by the Environmental Protection Agency and the Department of Natural Resources. Thus, a different method of removing rock from the bottom of harbors and channels is necessary, particularly a method that can be employed during any period of time throughout the year.

Floating barges having various type of equipment thereon adapted to work on the bottom of a body of water have been known for many years. One type of barge having a crane with an outwardly projecting boom thereon is known, which crane has an elongated torpedo-like tool which is lifted by the crane to an elevated position. This torpedo can weigh in the neighborhood of 30,000 pounds which subjects the boom of the crane to a fairly substantial load. At the time the torpedo-like tool is released for free fall back into the water, the sudden release of a 30,000 pound load subjects the boom to a severe amount of whipping, structural fatigue and possibly even failure of the structural members of the boom construction. Thus, the use of this type of equipment to effect a working of the bottom of a body of water has proven to be highly undesirable, time consuming and lacking in precision.

Another form of barge having vertically elevatable chisel-like members thereon is known. This barge is owned by Volker Stevin Dredging bv located in The Netherlands. This barge contains an opening through the central portion of the main deck and plural vertically elevatable chisel-like tools are elevatably supported therein, each being elevated by means of a separate hoist mechanism. The upright mast mounted on the upper deck of the barge is fixedly mounted to the deck and is incapable of any movement relative to the barge. If, however, the chisel-like tool is to work on a surface segment on the bottom of the body of water which is inclined to the horizontal, the inability of the mast to move relative to the upper surface of the barge will make it impossible for the chisel-like tool to strike the bottom surface of the body of water in a direction perpendicular to the general plane thereof, thus limiting the effective energy of the chisel. In addition, the deflection of the chisel would subject any guide structure provided on the barge to a severe amount of stress at the time of impact.

Accordingly, it is an object of this invention to provide a chisel barge having chisel structure thereon capable of working the bottom of a body of water on which the barge is floatably located.

It is a further object of this invention to provide a chisel barge, as aforesaid, having an upstanding mast mounted thereon from which is supported a chisel-like tool capable of being elevated to a raised position spaced from the bottom of the body of water and additionally capable of free falling to a lowered position to impact and effect a working of the bottom of the body of water.

It is a further object of this invention to provide a chisel barge, as aforesaid, having an upstanding mast mounted thereon which can be adjusted from a vertical plane to allow the chisel tools to impact an inclined rock surface perpendicular to the line of fall.

It is a further object of this invention to provide a chisel barge, as aforesaid, wherein shock absorbing structure is provided for normally maintaining the mast in an upright position and for absorption of any shock load generated by the chisel upon impact with the bottom of the body of water.

It is a further object of this invention to provide a chisel barge, as aforesaid, wherein a cable control device is provided for the cable utilized in elevating the chisel to a raised position above the bottom of the body of water, which cable control device prevents an over rotation of the cable drum and resulting "birdcaging" of cable from the cable drum provided therefor following a free fall and impact of the chisel with the bottom.

It is a further object of this invention to provide a chisel barge, as aforesaid, having a position maintaining control structure thereon which allows the barge operator to maintain the steadiness of the barge in its fixed location on the body of water.

It is a further object of this invention to provide equipment which is both durable and generally maintenance-free in its operation as well as, when service is required, easy to service due to the easy access to the tool-like ends on the chisels.

SUMMARY OF THE INVENTION

In general, the objects and purposes of the invention are met by providing a chisel barge having an elongated hull floatable on a body of water with position maintaining structure thereon for maintaining the position of the hull in a generally fixed location while in a floating condition spaced from land. A bracket is mounted on the hull, which bracket has an opening therethrough, the axis of which is inclined to the horizontal. A pivot bearing is provided for pivotally supporting the bracket on the hull for movement about a generally horizontal axis. An upstanding mast is provided on the bracket and is tiltably movable therewith about the aforesaid generally horizontal axis. A chisel having a tool-like end located on one end thereof is vertically movably mounted on the mast and through the aforesaid opening in the bracket. A hoisting mechanism is provided for effecting a raising of the chisel to a position spaced from the bottom of the body of water and for effecting a free fall thereof to a lowered position impacting and effecting a working on the aforesaid bottom of the body of water.

BRIEF DESCRIPTION OF THE DRAWINGS

Further objects and purposes of this invention will be apparent to persons acquainted with apparatus of this general type upon reading the following specification and inspecting the accompanying drawings, in which.

DETAILED DESCRIPTION

Figure 1:
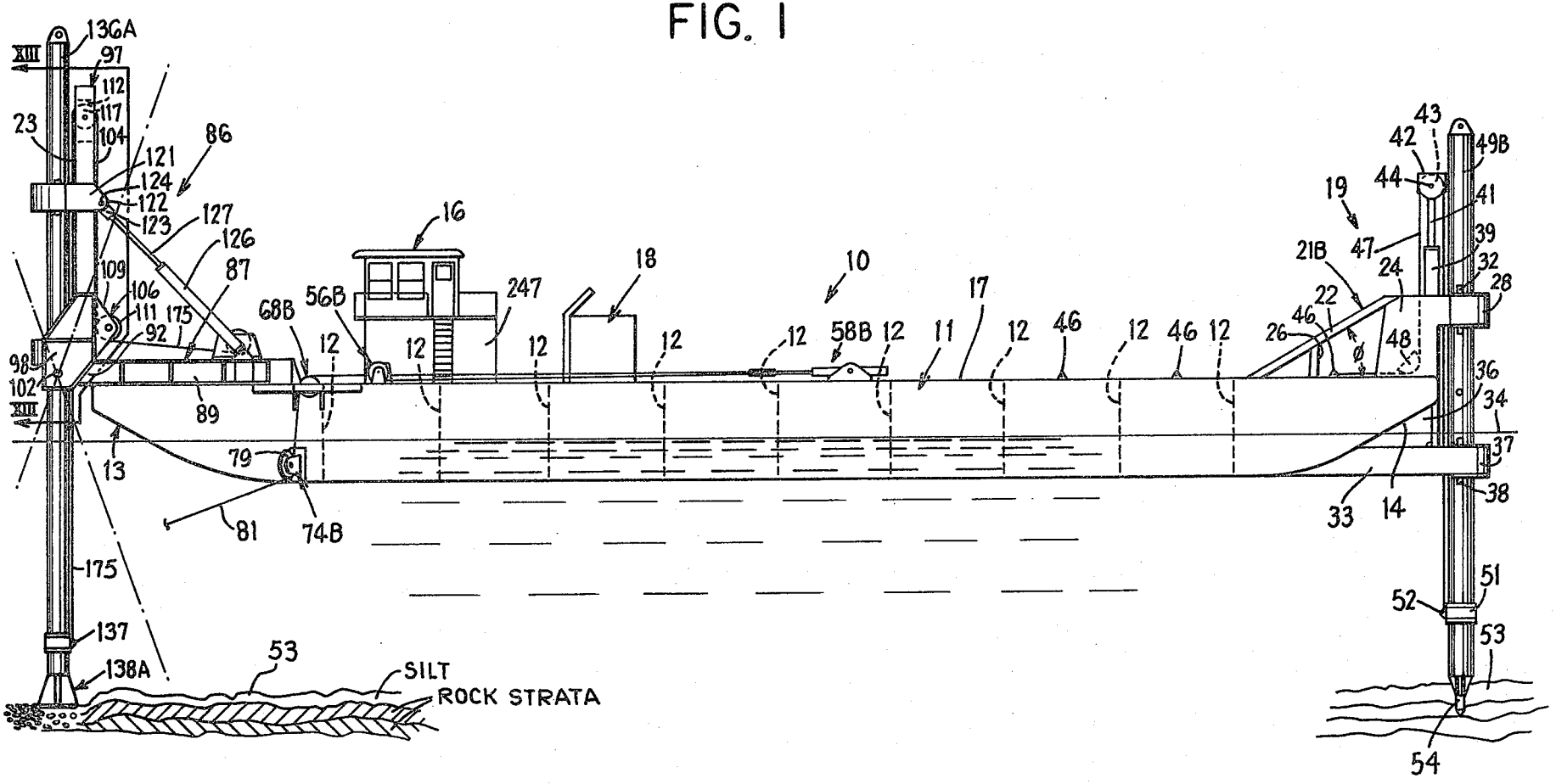
FIG. 1 is a side elevational view of a chisel barge embodying the invention.

Certain terminology will be used in the following description for convenience in reference only and will not be limiting. The words "up", "down", "right" and "left" will designate directions in the drawings to which reference is made. The words "forward" and "rearward" will refer to the fore and aft ends of the chisel barge, the "forward" end being the leftmost end illustrated in FIGS. 1 and 2. The words "in" and "out" will refer to directions toward and away from, respectively, the geometric center of the chisel barge and designated parts thereof. Such terminology will include the words above specifically mentioned, derivatives thereof and words of similar import.

Figure 2:
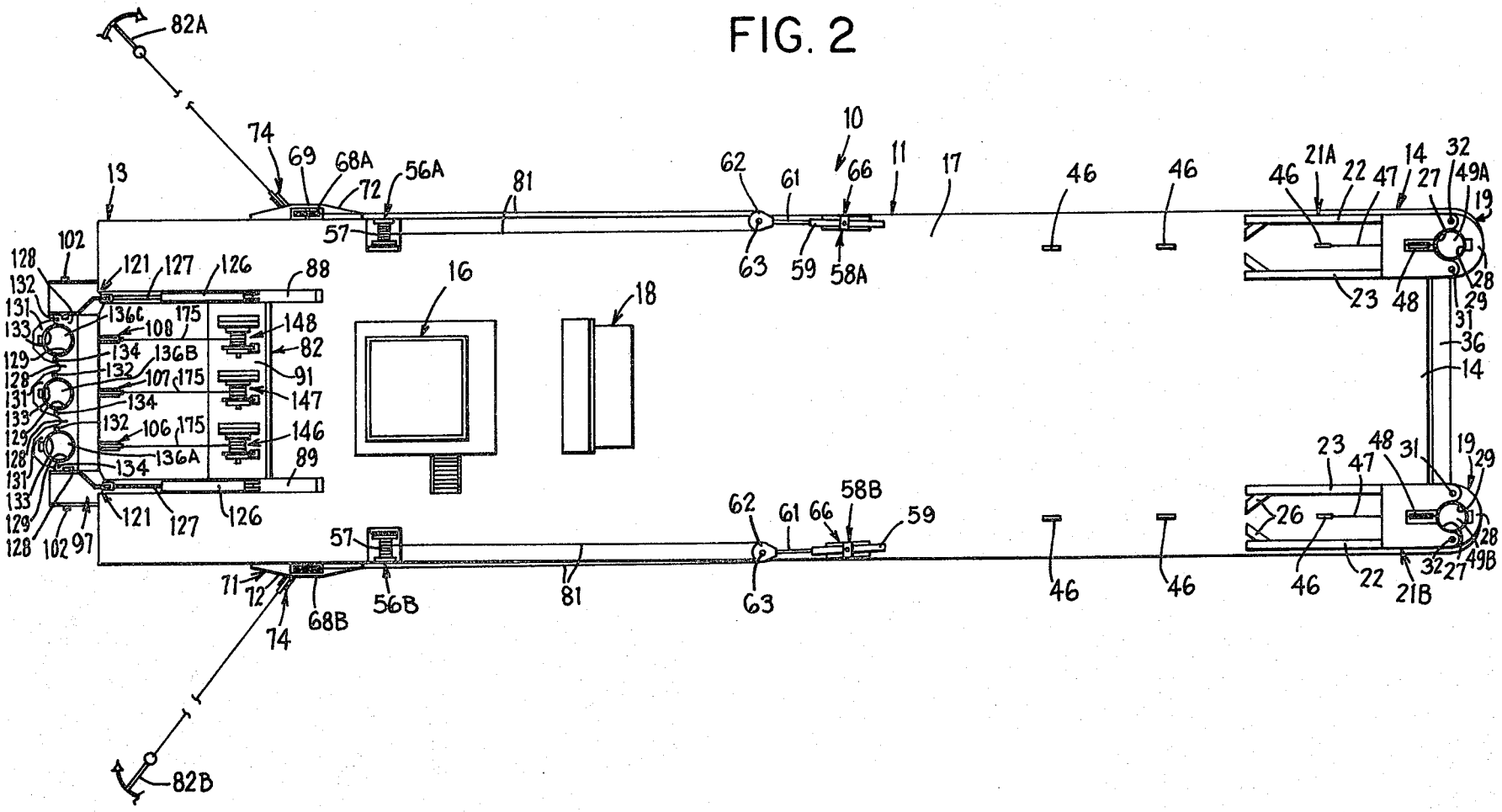
FIG. 2 is a top view thereof.

FIGS. 1 and 2 illustrate a chisel barge 10 embodying the invention. The barge 10 includes a hull 11 having the usual compliment of plural internal bulkheads spaced along the length and width of the hollow interior thereof as required in normal ship building practice. The bow 13 and the aft end 14 of the hull 11 is shaped to permit forward and aft movement of the hull through the water. In this particular embodiment, the chisel barge has no engine or drive train thereon for self-propelling the hull through the water. The particular chisel barge illustrated is adapted to be towed by another vessel from one location to another. However, it is to be understood that self-propelling means could be incorporated in the barge if so desired.

An operator's control room 16 is mounted on the upper surface of a deck 17 on the hull 11. The control switches and levers, discussed in detail below, for operating the equipment on the chisel barge are located in the control room 16 and will be described in more detail hereinbelow. In addition, an internal combustion engine, schematically illustrated at 18 is mounted on the upper surface of the deck 17 aft of the control room 16. The internal combustion engine 18 is utilized for purposes of driving several hydraulic pumps which will be discussed in more detail with reference to the hydraulic circuitry illustrated in FIG. 11.

Figure 15:
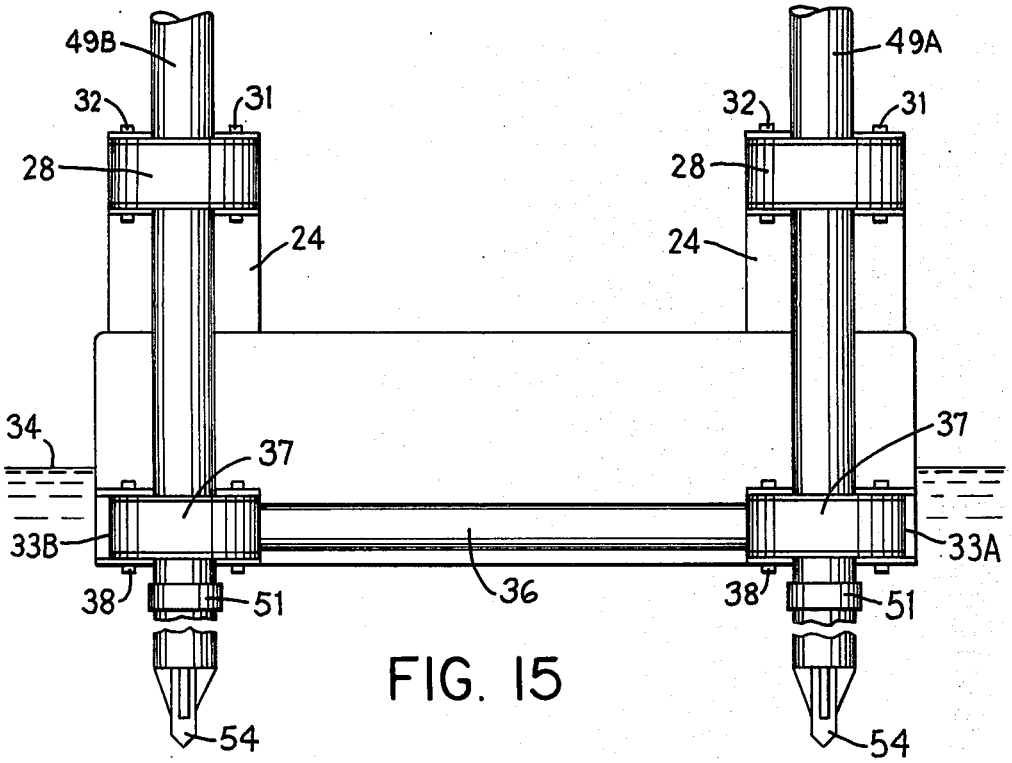
FIG. 15 is, a view of the rear end of the chisel barge.

A pair of position maintaining spud structures 19 (FIGS. 1, 2 and 15) is provided at the aft end 14 of the hull 11. The position maintaining spud structures 19 are both identical to each other and, accordingly, identical reference numerals are utilized in the following description but with the suffix "A" being utilized for the structure on the starboard side and the suffix "B" being utilized for the structure on the port side. A pair of laterally spaced bracket structures 21A and 21B is mounted on the upper surface of the deck and each consists of a pair of parallel beams 22 and 23 which are inclined to the horizontal at an angle $\theta$ shown in FIG. 1. The upwardly inclined beams 22 and 23 are maintained in a fixed position by appropriate attachment to the upper spud well structures 24 fixedly secured to the deck 17 at the aft end 14 of the hull 11 and to the upper ends of the beams 22 and 23. Appropriate bracing 26 is provided on the beams 22 and 23 to prevent an undue amount of flexing thereof. Each upper spud well structure 24 has a generally semicircular shaped recess 27 therein, the longitudinal axis of which is generally perpendicular to the plane of the deck 17, facing aftwardly of the hull 11. A gate member 28 having a generally semicylindrical shaped recess 29 therein is pivotally secured to the upper spud well structure 24 at one lateral side thereof for pivotal movement about a hinge 31 having an upright vertical axis. A locking pin 32 is utilized to hold the gate 28 to the upper spud well structure 24 on a side of the cylindrical guide well defined by the semicylindrical recesses 27 and 29 remote from the hinge 31. In this particular embodiment, the locking pin 32 can be removed from aligned openings in the upper spud well structure 24 and in the gate 28 to permit the gate 28 to pivot about the axis of the hinge 31.

A pair of laterally spaced lower spud well structures 33A and 33B (FIG. 15) project from the aft end 14 of the hull 11 below the waterline 34. Appropriate bracing 36 is provided therebetween and thereon for preventing undesired movement of the lower spud well structures 33A and 33B relative to the hull 11. Each lower spud well structure 33A and 33B has a gate 37 pivotally secured thereto by structure that is generally identical to the structure associated with the gates 28. That is, each gate 37 is maintained in a fixed position relative to the lower spud well structures 33A and 33B by a locking pin 38 received in aligned openings in the end of the lower spud well structures 33A and 33B remote from the hull 11 and gate 37. The end of the lower spud well structure remote from the hull has a semicylindrical recess therein as does the gate 37 such that when the gate 37 is in the closed position illustrated in FIGS. 1 and 15, a cylindrical guide well is defined thereby. The longitudinal axis of the cylindrical guide well defined by the semicylindrical recesses in the lower spud well structures 33A and 33B and the gates 37 is axially aligned with the cylindrical guide well defined by the semicylindrical recess segments 27 and 29 described above.

A hydraulic cylinder 39 is mounted on each of the upper spud well structures 24, the longitudinal axis of which extends in the upright vertical direction generally perpendicular to the plane of the deck 17. An elongated piston rod 41 is reciprocably mounted in the cylinder 39. A pulley housing 42 having a pulley 43 rotatably mounted therein for rotation about an axis 44 is fixedly secured to the upper end of the piston rod 41 and is movable therewith.

In this particular embodiment, plural cleats are arranged centrally frontwardly of each position maintaining spud structure 19 as shown in FIG. 2. Each cleat 46 is adapted to have secured thereto an end of a cable 47. In this embodiment, the cable 47 is fixedly secured to the aftmost cleat 46, extends around a turning block 48 located within the upper spud well structures 24 and extends upwardly therefrom around the pulley 43 and down through the axially aligned cylindrically shaped openings defined by the semicylindrical recesses 27 and 29 in the upper spud well structure 24 and gate 28, respectively, as well as in the end of the lower spud well structures 33A and 33B and associated gates 37.

A pair of spuds 49A and 49B are each received in the aligned cylindrical guide wells described above and are adapted to move vertically therein. A free turning collar construction 51 is secured to the spud adjacent the lower end thereof and the free end of the cable 47 is secured to the collar as at 52. Thus, as the piston rod 41 and pulley housing 42 are driven upwardly, the spuds 49A and 49B will be lifted away from the bottom 53 of the body of water. The lower end of each spud 49A and 49B has a pointed structure 54 thereon to enable the spuds to become firmly anchored in the bottom 53 of the body of water.

Figure 11:
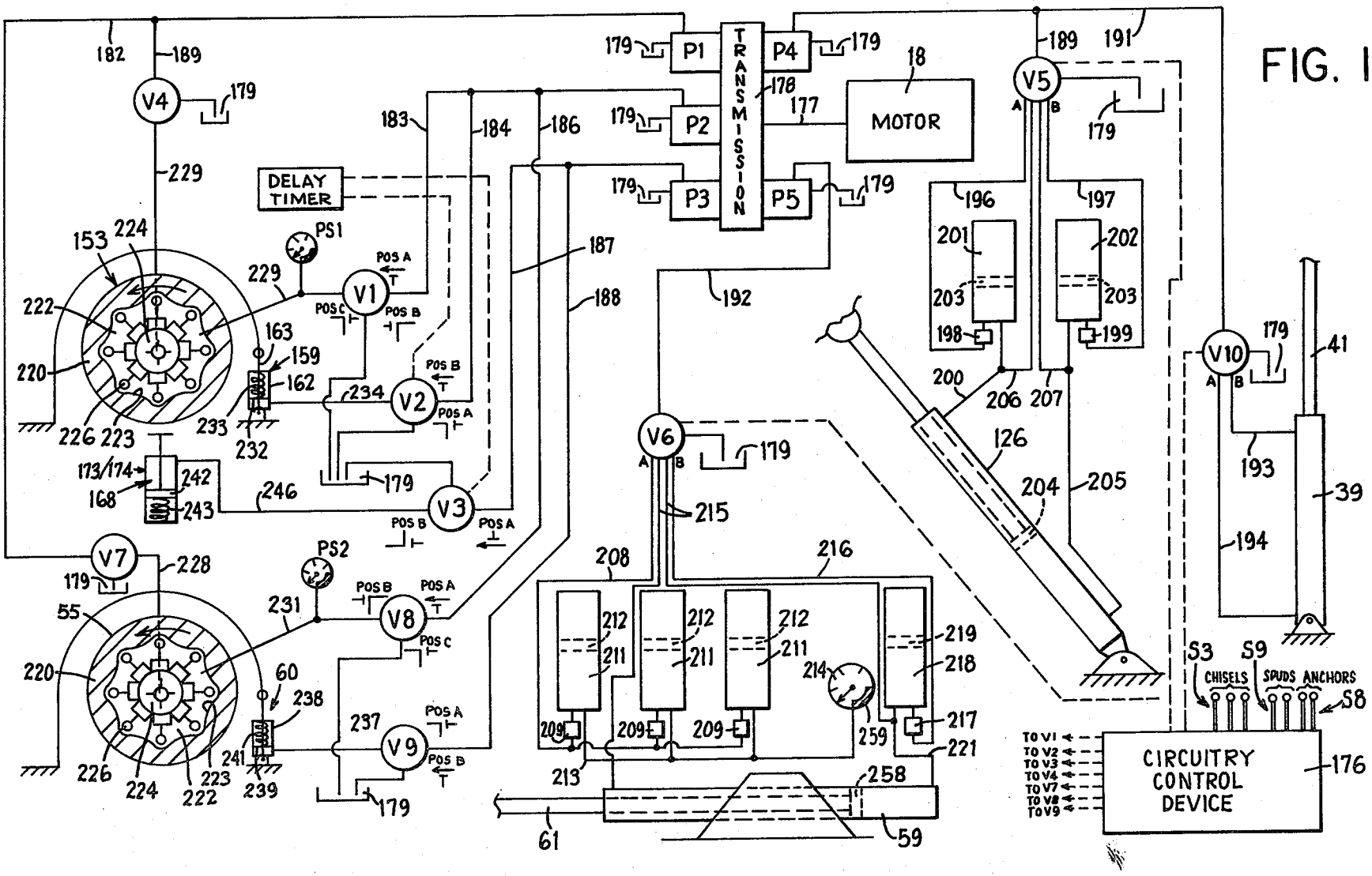
FIG. 11 is a schematic illustration of the various components provided on the chisel barge.

A swing winch 56A is mounted along the starboard side of the hull 11 laterally adjacent the control room 16. An identical swing winch 56B is mounted on the port side of the hull 11 in a laterally aligned relation to the swing winch 56A. Each swing winch 56A and 56B includes a Haegglunds 8385 winch drive 55 (FIGS. 7 and 12) powering a cable drum 57. The Haegglunds 8385 winch drive is schematically illustrated in FIG. 11 and a more detailed discussion concerning its operation is set forth below. A band braking mechanism 60 (FIG. 11) is provided for holding the drum 57 in a fixed position to prevent cable from being inadvertently unwound from the drum.

A hydraulic cylinder tensioning device 58A is mounted aft of the control room 16 about midlength of the hull 11 and along the right edge thereof. Similarly, a hydraulic cylinder tensioning device 56B is mounted on the deck 17 laterally aligned with the tensioning device 56A. The hydraulic cylinder tensioning devices 56A and 56B each include an elongated hydraulic cylinder 59 and an elongated piston rod 61 reciprocably movable therein. A pulley housing 62 having a pulley 63 rotatably mounted therein for movement about an axis of rotation 64 is fixedly secured to the free end of the piston rod 61.

Figure 7:
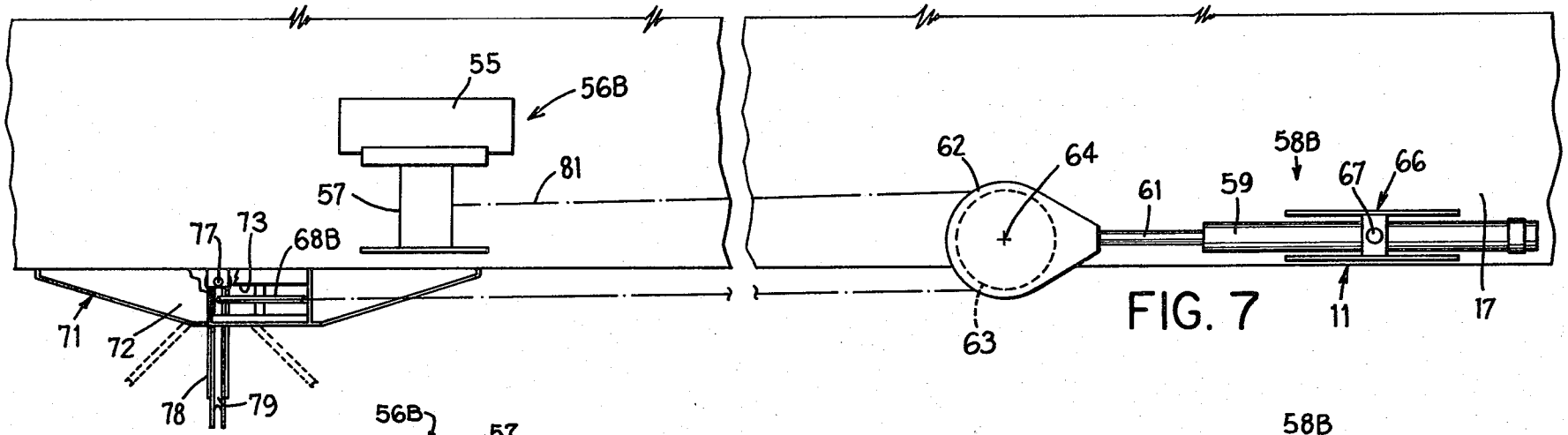
FIG. 7 is an enlarged fragmentary top view of the chisel barge illustrated in FIG. 6.
Figure 6:
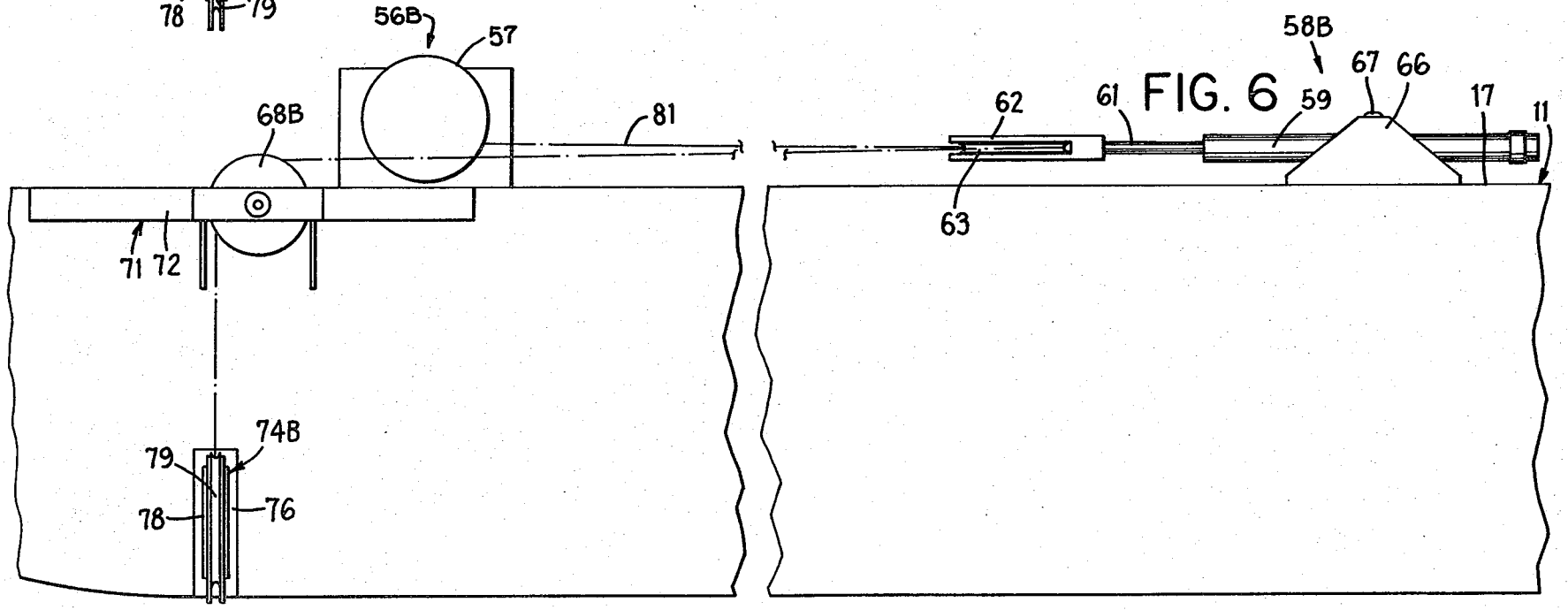
FIG. 6 is an enlarged fragmentary side elevational view of the chisel barge.

More specifically, and referring to FIGS. 6 and 7, the cylinder 59 is fixedly secured to a mounting member 66 which is, in turn, fixedly secured to the deck 17 of the hull 11. A vertically upright pivot pin 67 is provided on the mounting member 66 and effects a securement of the hydraulic cylinders 59 to the mounting member 66. Thus, the hydraulic cylinders 59 are both pivotal about an upright axis defined by the pivot pin 67, which upright axis is generally perpendicular to the plane of the deck 17. The purpose of this construction will be explained below.

A large diameter turning sheave 68A is mounted laterally outboard of the starboard edge of the hull 11 in a sheave support structure 69. Similarly, a large diameter turning sheave 68B is rotatably mounted in a sheave support structure 71 mounted laterally outboard of the port edge of the hull 11. More specifically, both the sheave support structure 69 and the sheave support structure 71 are identical to each other and each include a beam member 72 with an opening 73 therein in which is located the appropriate sheave 68A or 68B. In this particular embodiment, the axis of rotation of each sheave 68A and 68B is parallel to the plane of the deck 17 and perpendicular to the longitudinal axis of the barge. Further, the sheaves 68A and 68B are both axially aligned with each other and are located just forwardly of the swing winches 56A and 56B, respectively.

Also mounted on both outside lateral surfaces of the hull 11 is a further sheave arrangement 74A and 74B located below the waterline 34. More specifically, the sheave arrangement 74A is mounted on the starboard side of the hull 11 immediately below the sheave 68A and the sheave 74B is mounted on the port side of the hull 11 immediately below the sheave 68B. Referring to FIG. 6, the sheave arrangement 74B includes a bracket plate 76 fixedly secured to the outside surface of the hull and has a hinge structure 77 fixedly secured thereto. A sheave housing 78 is pivotally secured to the hinge 77 for movement about the hinge axis, which in this particular embodiment is a vertical axis generally perpendicular to the plane of the deck 17. A sheave 79 is rotatably supported in the sheave housing 78 for movement about a generally horizontally aligned axis of rotation. The sheave housing 78 and rotatably supported sheave 79 therein is movable about the hinge 77 between various positions, such as is illustrated in broken lines in FIG. 7.

A cable 81 is wound onto each cable drum of each swing winch 56A and 56B. The cable 81 extends radially away from each drum toward and around the pulley 63 of each tensioning device 58A and 58B and thence around each associated sheave 68A and 68B as well as the sheaves 79 in each of the sheave arrangements 74A and 74B. An anchor 82A is secured to the end of the cable 81 wound onto the cable drum 57 of the swing winch 56A and an anchor 82B is secured to the end of the cable 81 wound onto the cable drum 57 of the swing winch 56B.

The purpose and manner in which the swing winch 56A and 56B as well as the tensioning devices 58A and 58B serve to control the position of the chisel barge 10 will be explained in more detail below.

A chisel mast support structure 86 is fixedly secured to the deck 17 at the bow end 13 of the chisel barge 10. The chisel mast support structure 86 includes a generally H-shaped bracket member 87 having a pair of legs 88 and 89 on opposite sides of and extending parallel to the longitudinal centerline of the hull 11. A platform 91 is connected to each leg 88 and 89 intermediate the ends thereof to define the cross member of the aforementioned H-shape. The forward end of each of the legs 88 and 89 includes a front portion 92 and 93 (FIG. 13) which extends frontwardly beyond the bow 13 as illustrated in FIG. 1. Each of the front portions 92 and 93 has an opening 94 and 96, respectively, therethrough, the axes of which are aligned and extend generally perpendicular to the longitudinal axis of the hull 11.

Figure 13:
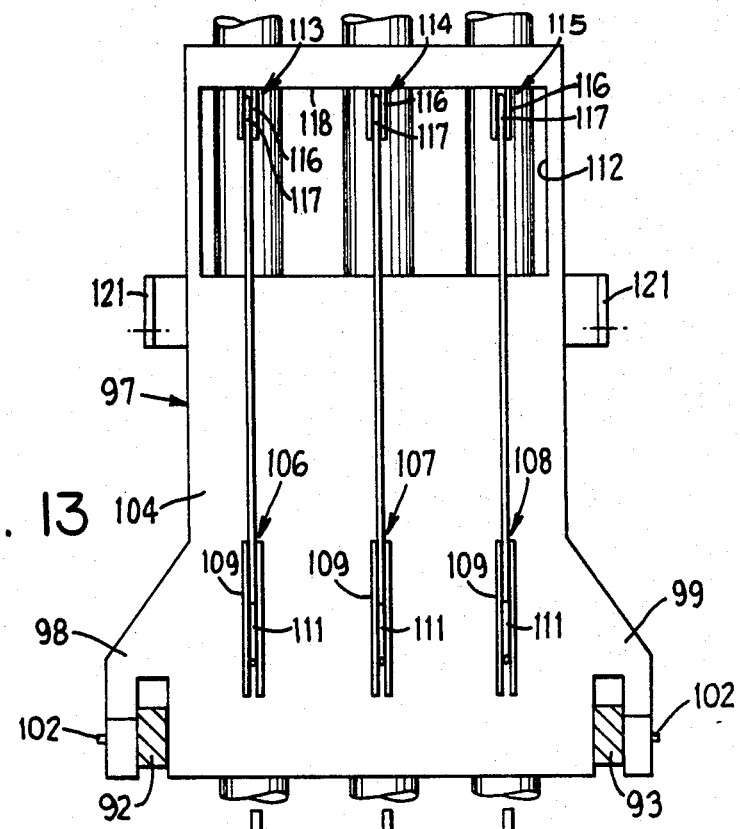
FIG. 13 is a sectional view taken along the line XIII—XIII of FIG. 1.
Figure 14:
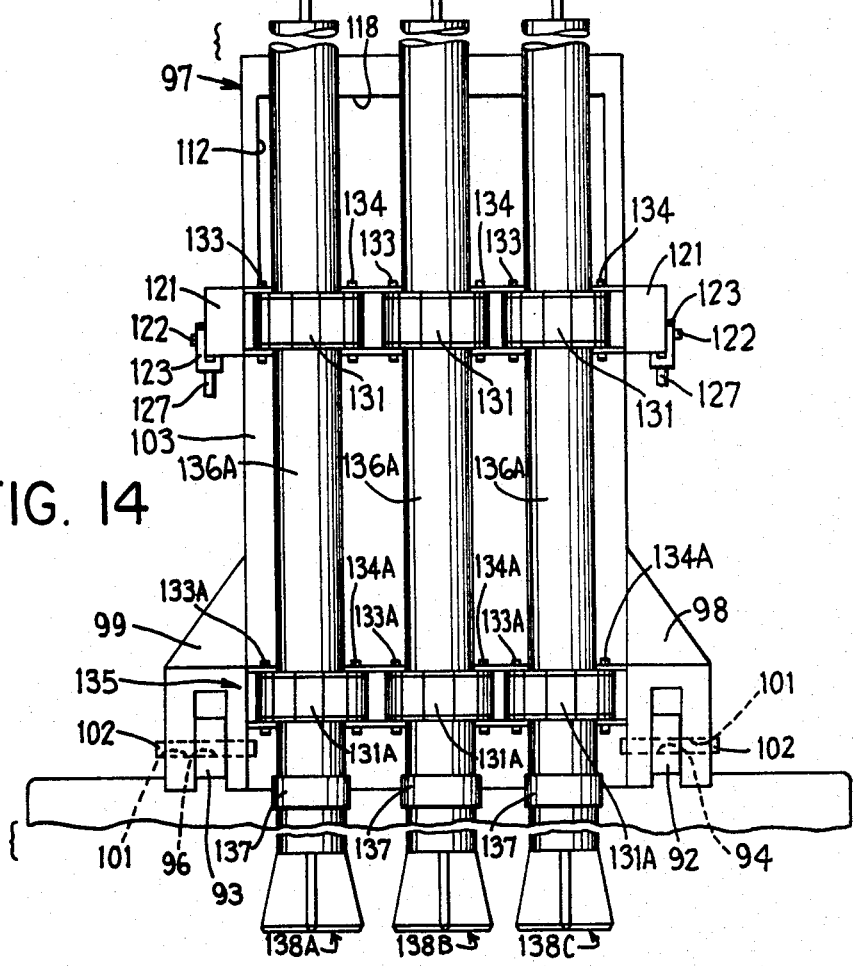
FIG. 14 is a view of the front end of the chisel barge.

An upstanding mast 97 is provided which has a pair of bifurcated bearing members 98 and 99 (FIG. 14) located at horizontally spaced locations along the bottom edge thereof. Each bearing member has axially aligned openings 101 therethrough which are axially aligned with the openings 94 and 96 in the front portions 92 and 93 of the bracket member 87. An elongated pivot pin 102 is received in each of the aligned set of openings 94, 101 and 93, 101 to effect a pivotal supporting of the mast 97 about the axis of the pivot pins 102. The mast 97 has a frontwardly facing wall 103 and a rearwardly facing wall 104. As illustrated in FIG. 13, three axially aligned pulley structures 106, 107 and 108 are fixedly secured to the rearwardly facing wall 104. Each pulley structure 106, 107 and 108 includes a pulley housing 109 and a rotatably supported pulley 111 mounted therein about an axis which extends generally horizontally and parallel to the axis of the pivot pin 102.

An opening 112 is provided in the upstanding mast 97 adjacent the upper edge thereof and in said opening is affixedly mounted three additional pulley structures 113, 114 and 115. Each pulley structure 113, 114 and 115 includes a pulley housing 116 and a pulley 117 rotatably supported in the pulley housing for rotation about an axis of rotation that is parallel to the axis of rotation of each of the pulleys 111. In this particular embodiment, each pulley 117 in each of the pulley structures 113, 114 and 115 is vertically and radially aligned with an associated one of the pulleys 111 in the pulley structures 106, 107 and 108. In this particular embodiment, each of the pulley housings 116 is secured to a downwardly facing surface 118 in the opening 112. The diameter of the pulleys 116 is preferably larger than the front-to-back thickness of the upstanding mast 97.

A bracket 121 (FIG. 1) is secured to the mast 97 along each lateral edge thereof intermediate the top and bottom thereof. Each bracket 121 has a bifurcated segment 122 thereon adapted to receive a clevis 123 pivotally therein and pivotal about the axis of a pin 124.

A hydraulic cylinder 126 is pivotally secured at one end thereof to each leg 88 and 89 of the bracket member 87. A piston rod 127 is reciprocably mounted in each of the cylinders 126. The aforementioned clevis 123 is fixedly secured to the free end of the piston rod 127. Thus, the cylinder 126 and the piston rod 127 serve to maintain the mast 97 in its upright position as well as facilitating appropriate pivotal movement thereof about the pivot pins 102 and between the broken lines intersecting same.

Plural upper guide well members 128 (FIG. 2) are fixedly secured to the frontwardly facing wall 103 of the mast 97 and extends generally horizontally across a majority of the width of the mast. The upper guide well members 128 together have plural, here three, semicylindrical recesses 129 therein, the axes of which extend generally perpendicular to the plane of the deck 17. In this particular embodiment, the three such semicylindrical recesses 129 are equidistantly spaced between the lateral edges of the mast 97. Plural gates, here three gates 131 are pivotally secured to the guide well members 128 for movement about vertically upright pivot axes 132. Each gate 131 has a semicylindrical recess 133 therein which mates with the semicylindrical recesses 129 to form an upper cylindrical guide well. Each gate is fixedly positioned in its closed position by a locking pin 134.

A similar guide construction 135 is located immediately therebelow and the lower cylindrical guide wells therein are vertically axially aligned with the upper guide wells described above. Thus, further comment is believed unnecessary, however, the same reference numerals utilized hereinabove to describe this structure are utilized with respect to the lower guide structure in FIG. 14 but with the suffix "A" added thereto.

Figure 8:
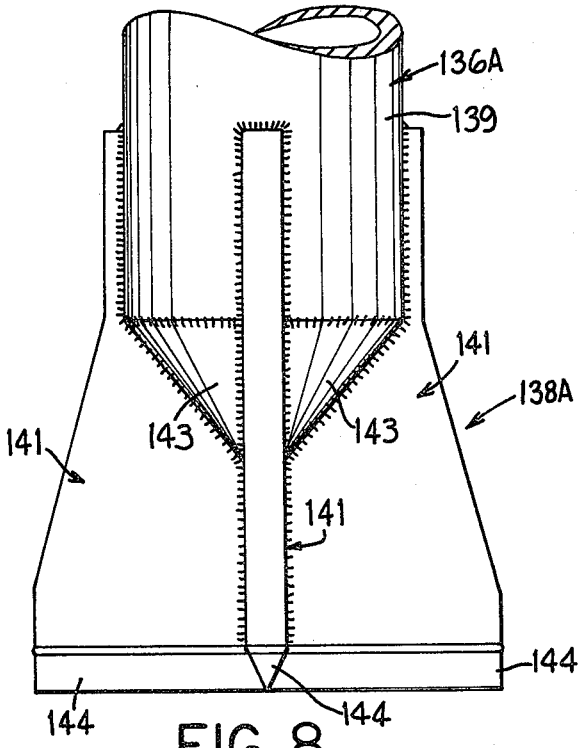
FIG. 8 is a partial side view of the lower end of the chisel.
Figure 9:
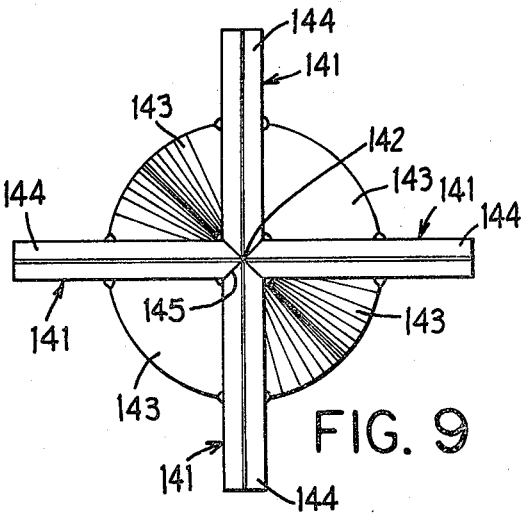
FIG. 9 is a bottom view of the chisel.

Plural chisels 136A, 136B and 136C are vertically reciprocably mounted in the aligned cylindrical guide wells. A rotatable collar 137 is secured to each chisel 136A, 136B and 136C adjacent the lower end thereof. In addition, a tool bit 138A is secured at the bottom end of the chisel 136A as is a tool bit 138B and 138C secured to the bottom end of each of the chisels 136B and 136C, respectively. Since each of the tool bits 136A, 136B and 136C are identical to each other, only the details of the tool bit 138A will be described in detail utilizing the illustrations of FIGS. 8, 9 and 10. As shown in FIG. 8, each chisel 136A is made up from a hollow cylindrical tube 139 of considerable weight. Fastened to the bottom end thereof are plural blades or cutting edge mounts 141 mounted 90° spaced apart from one another and intersecting along the central axis 142 of the tube 139. The inner edges 145 of each of the cutting edge mounts 141 are appropriately fitted to cause the inner edges to interfit with one another as clearly illustrated in FIG. 9. Each of the cutting edge mounts 141 in this particular embodiment is weldably secured to each other and to the tube 139. Appropriate conical segments 143 are utilized to fill the angular space between mutually adjacent blade members 141.

Figure 10:
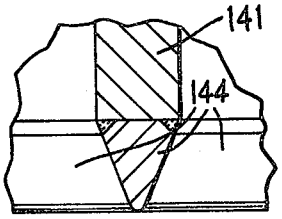
FIG. 10 is an enlarged sectional view of a cutting blade on the lower end of the chisel.

In this particular embodiment, manganese cutting edges 144 having a triangular cross section are weldably secured to the lower edge of each of the blades 141 as shown in FIG. 10. The manganese edges, while being weldably secured, can be periodically replaced due to wear and/or appropriate dulling thereof.

Figure 3:
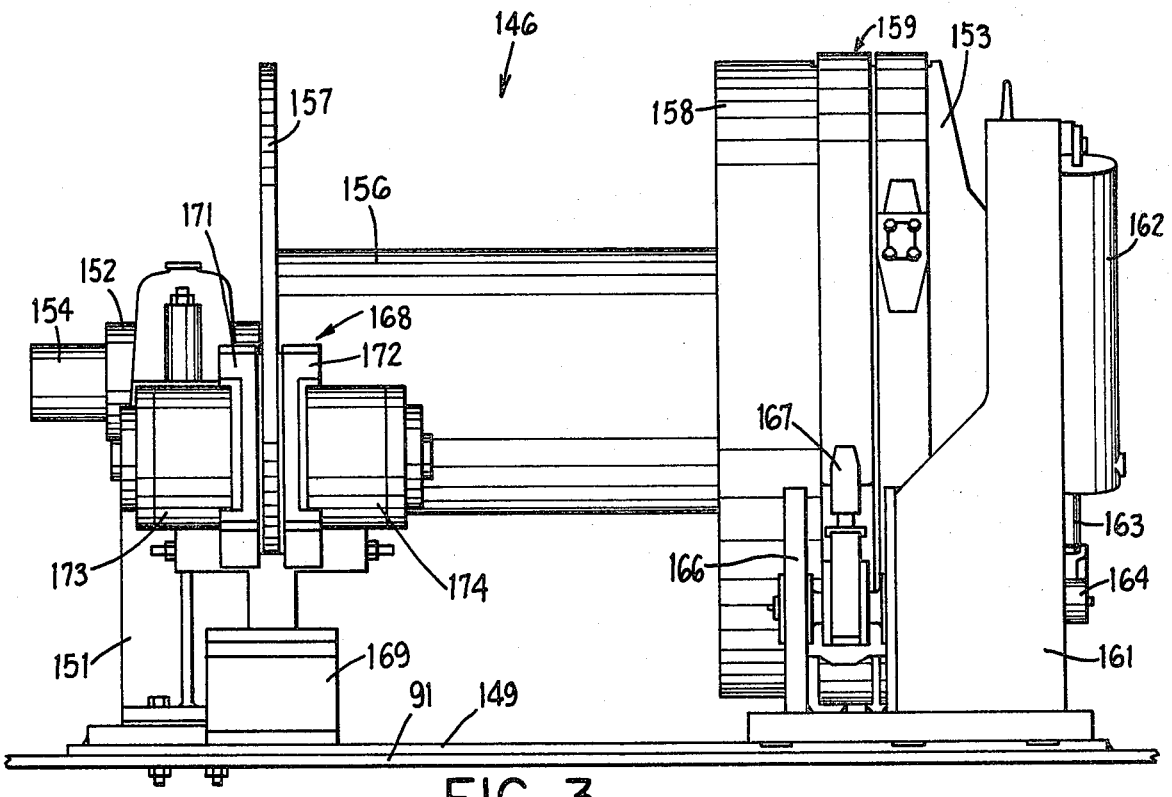
FIG. 3 is a front elevational view of a cable drum.
Figure 5:
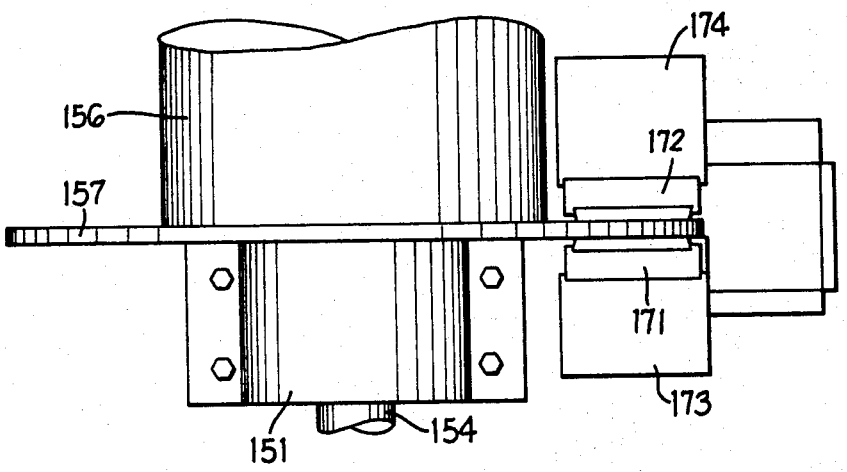
FIG. 5 is a fragmentary top view of the cable drum.
Figure 4:
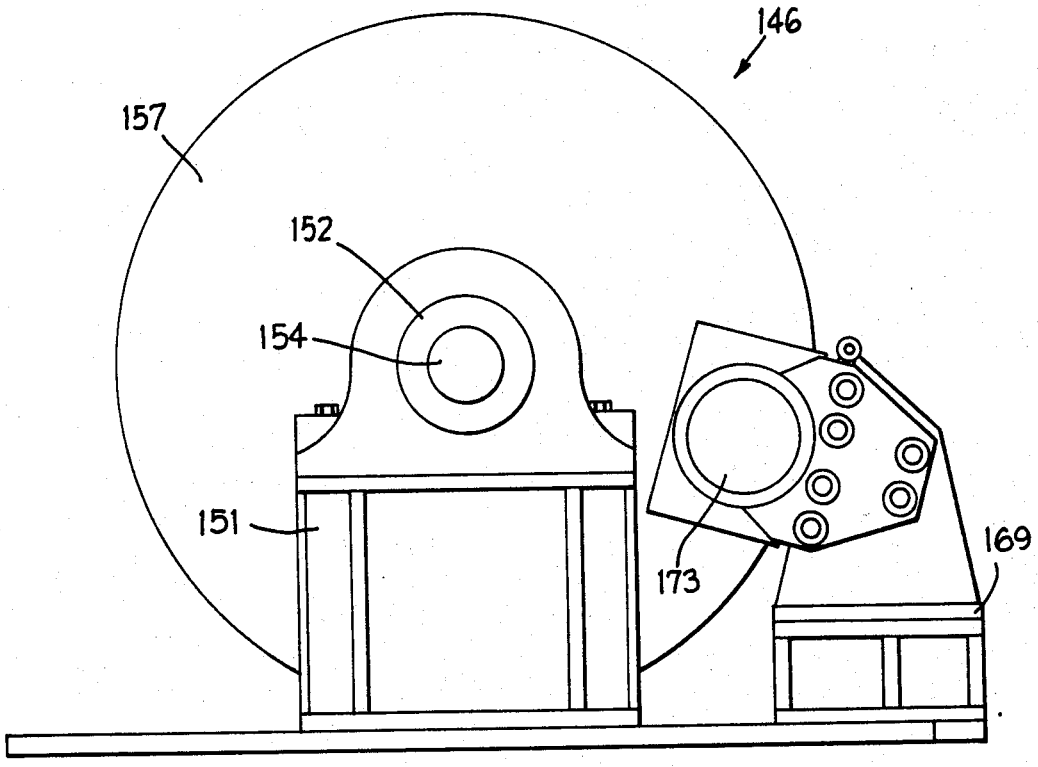
FIG. 4 is an end elevational view of the cable drum.

Plural hoisting winches, here three hoisting winches 146, 147 and 148 are fixedly mounted on the platform 91 extending between the legs 88 and 89 of the bracket member 87. In this particular embodiment, the hoisting winches 146, 147 and 148 are of the same model and type as the swing winches 56A and 56B. Since each winch 146, 147 and 148 is identical to each other, only one winch 146 will be described in detail. Referring to FIGS. 3, 4 and 5, the winch 146 includes a base plate 149 fixedly secured to the platform 91. A pillow block 151 having a self-aligning bearing construction 152 thereon is fixedly mounted on the base plate 149. Axially disposed from the pillow block 151 on the base 149 is a Haegglunds 8385 hydraulic winch drive motor 153. Each drive motor 153 has an output member thereon. A cable drum 156 is fixedly secured to the output member. In this particular embodiment, the cable drum 156 has a pair of radially extending end flanges 157 and 158 between which cable strands are guided. A centerline drum shaft 154 is secured to the outboard drum flange which also serves as a disk for the caliper brake 168 and is rotatably supported by the bearing construction 152 in the pillow block 151. The side flange 158 is quite wide and is secured to the output member of the drive motor 153 and cooperates with a conventional band brake mechanism 159. In this particular embodiment, a pedestal 161 fixedly secured to the upper surface of the base 149 has a power cylinder 162 fixedly secured thereto adjacent the upper end of the pedestal 161. A piston rod 163 is reciprocally mounted within the cylinder 162. A shaft 164 is rotatably supported in the pedestal 161 and a bearing plate 166. The shaft 164 defines a crank arm, one end of which is fixedly secured to the reciprocal piston rod 163 and the other end of which is secured to the band brake mechanism 159 as at 167. Thus, operation of the cylinder 162 to rotate the crank arm 164 will effect a tightening of the band brake mechanism 159 to cause a sufficient frictional force to be developed between the band brake mechanism 159 and the peripheral surface of the side flange 158 of the drum 156 to fixedly hold same and any load that may be attached to the free end of any cable wound thereon in a fixed location. The specific control circuitry controlling the operation of the power cylinder 162 will be described below.

In addition to the foregoing band brake mechanism 159, a caliper brake 168 is fixedly secured to a pedestal 169 which is, in turn, fixedly secured to the upper surface of the base plate 149. The caliper brake 168 includes a pair of braking members 171 and 172 mounted on opposite sides of the side flange or caliper disk 157 of the drum 156. Appropriate brake actuating devices 173 and 174 are fixedly mounted on the pedestal 169 and effectively operate the braking members 171 and 172, respectively, to move same into frictional engagement with opposite sides of the side flange 157 to effectively halt only the rotational and cable inertia forces generated during the free fall operation of the chisels. The caliper brake 168 cannot hold the chisels in an elevated position. Only the band brake mechanism 159 has adequate strength to hold the chisels in an elevated position. The purpose of the provision of the caliper brake 168 will be explained in detail below.

A separate cable 175 is wound onto each cable drum of each power winch 146A, 146B and 146C and each cable is secured to the collar 137 at the lower end of each chisel 136A, 136B and 136C.

Referring now to FIG. 11, plural valve components are incorporated into a control circuit controlled by an appropriate circuitry control device 176. The circuitry control device 176 is shown in more detail in FIG. 12. In addition to the circuit components described above, it is to be noted that the engine 18 drives through its output shaft 177 a pump transmission device 178 which in turn drives plural hydraulic pumps, here schematically illustrated pumps P1, P2, P3, P4 and P5. Each of these pumps draws hydraulic fluid from a common reservoir 179. The outlet of the pump P1 is connected to the inlet to a pair of valves, namely, valves V4 and V7 through hydraulic lines 181 and 182. Similarly, the outlet of the pump P2 is connected to the inlet of valves V1, V2 and V8 through hydraulic lines 183, 184 and 186. The outlet to the pump P3 is connected to the inlet of valves V3 and V9 through hydraulic lines 187 and 188. The outlet to the pump P4 is connected to the inlet of valves V5 and V10 through hydraulic lines 189 and 191. The outlet to the pump P5 is connected to the inlet of valve V6 through a hydraulic line 192.

The outlets A and B of the valve V10 are connected to opposite ends of the lift cylinder for the positioning spuds 49A and 49B, namely, the lift cylinders 39 through lines 193 and 194.

The outlets A and B of the valve V5 are connected through appropriate hydraulic lines 196 and 197 to check valves 198 and 199. The outlet of the check valve 198 is connected to the inlet of a hydraulic accumulator 201. Similarly, the outlet of the check valve 199 is connected to the inlet of a hydraulic accumulator 202. The outlet of the accumulator 201 is connected in fluid circuit with one end of the cylinder 126 through a hydraulic line 200. The outlet of the accumulator 202 is connected in fluid circuit with the other end of the cylinder 126 through a hydraulic line 205. In this particular embodiment, each of the accumulators 201 and 202 have a compressible gas on the upper side of a reciprocal piston 203 therein so that the hydraulic fluid entering the accumulator through the check valves 198 and 199 will compress the gas on the upper side of each piston until all hydraulic forces are equalized on opposite ends of the reciprocating piston 204 in the cylinder 126. If, for example, it is desired to alter the vertical position of the mast 97, fluid is introduced into the appropriate end of the hydraulic cylinder 126 to shift the reciprocal piston 204 therein longitudinally of the cylinder housing. In this particular instance, the hydraulic fluid exiting the end of the cylinder 126 opposite the end whereat the hydraulic fluid enters the hydraulic cylinder will return through the valve V5 to the reservoir 179 through appropriate hydraulic lines 206 and 207.

The outlet A of the valve V6 is connected through a hydraulic line and plural check valves 209 to plural accumulators 211 identical in kind to the accumulators 201 and 202. That is, each accumulator 211 has a reciprocal piston 212 therein above which is located a compressible gas. The outlet of each of the accumulators 211 is connected through a hydraulic line 213 to one end of the hydraulic cylinder 59 and a pressure gauge 214 which is physically mounted in the control room 116 so that the barge operator can utilize same in determining whether the stress on the cables 81 to the anchors 82A and 82B is reaching an upper limit when inordinately rough seas exist.

The outlet B of the valve V6 is connected through a hydraulic line 216 and a check valve 217 to the inlet to an accumulator 218 identical in kind to the aforementioned accumulators. That is, a reciprocal piston 219 is mounted therein above which is located a compressible gas. The outlet of the accumulator is connected through a hydraulic line 221 to an end of the hydraulic cylinder 59 remote from the hydraulic line 213 connection to the cylinder 59. Appropriate return lines 215 are provided for returning hydraulic fluid to the reservoir 179 through the valve V6, similar to the lines 206 and 207 connected to the valve V5.

The motors 55 and 153 are both Haegglunds 8385 winch motors. Since each of the winch motors are identical, common reference numerals will be utilized hereinafter to describe the general construction of same. Each motor 55 and 153 has a rotatable stator 220 with an interior cavity 222 therein, which interior cavity has an undulating interior surface 223. A rotor 224 is fixedly mounted in the cavity 222, which rotor has plural radially outwardly drivable cam rollers 226 oriented thereon. As cam rollers 226 are systematically driven radially outwardly into engagement with the undulating cam surface 223, a very powerful rotary drive of the stator 220 is effected. The outlet of the valve V4 and of the valve V7 are connected to the interior of the rotor 224 of each drive motor 153 and 55 through hydraulic lines 227 and 228, respectively.

The outlet of the valve V1 and the outlet of the valve V8 are both connected to the interior cavity 222 of an associated one of the drive motors 153 and 55, respectively, through hydraulic lines 229 and 231, respectively. The valves V1 and V8 are each three position valves with each position being schematically shown adjacent thereto. For example, position A of the valves V1 and V8 will supply fluid from the pump P2 directly to the interior cavity 222 of the drive motors 153 and 55. Similarly, position B of each valve V1 and V8 will dump fluid from the pump back into the reservoir 179. Position C of both valves V1 and V8 connects the hydraulic line 229 and 231 to the reservoir 179 to dump the hydraulic fluid in the cavity 222 into the reservoir 179.

The valves V2 and V9 each control a band brake mechanism. As is illustrated in FIG. 11, the cylinder 162 of the band brake mechanism 159 has a piston 232 reciprocally mounted therein. A spring 233 is provided between one end of the cylinder 162 and the piston 232. A hydraulic line 234 is connected to the outlet of the valve V2 and the cylinder 162 on a side of the piston 232 remote from the spring 233. The valve V2 is a two-position valve with position A connecting the hydraulic line 234 to the hydraulic reservoir 179. Position B connects the hydraulic line 234 to the pump P2 to urge the piston 232 against the resilient return force of the spring 233 to disengage the band brake mechanism 159.

The band brake mechanism 60 is utilized in association with each of the drive motors 55 in each of the swing winch devices 56A and 56B. The band brake mechanism 60 is generally identical to the band brake mechanism 159 and, therefore, further discussion pertaining to same is unnecessary. A hydraulic line 237 is connected to and extends between the outlet of the valve V9 and a hydraulic brake actuator cylinder 238 of the band brake mechanism 236 particularly on a side of a piston 239 reciprocally mounted therein remote from a spring 241. The valve V9 is like the valve V2, namely, a two-position valve. Position A connects the hydraulic line 237 to the reservoir 179. Position B connects the hydraulic line 237 to the pump P3.

The caliper braking mechanism 168 utilized in association with each of the power winches 146, 147 and 148 is schematically shown in FIG. 11. A piston 242 is reciprocally mounted in each brake actuator 173 or 174 against the resilient force of a spring 243 located between one end of the hydraulic actuator and the piston 242. A hydraulic line 246 is connected to and extends between the end of each hydraulic actuator 173, 174 on a side of the piston 242 remote from the spring 243 and the outlet of the valve V3. The valve V3 is a two-position valve. Position A connects the hydraulic line 246 to the pump P3 to urge the braking members 171 and 172 away from the side flange or caliper disk 157 on the drum 156. Position B connects the hydraulic line 246 to the reservoir 179 to cause the spring 243 to effect an application of the caliper braking members 171 and 172 to the caliper disk 157 of each of the drums 156.

While the schematic representation of each of the drive motors 55 and 153 is believed adequate for purposes of this disclosure, further details concerning the Haegglunds 8385 winch motor can be derived by contacting A. B. Haegglund and Soenar
S-890 42 Mellansel
Sweden or Haegglund Products
15760 West Hardy
Houston, Tex. 77060

OPERATION

Although the operation of the device embodying the invention has been indicated somewhat above, said operation will be described in detail hereinbelow to assure a more complete understanding of the invention.

Figure 12B:
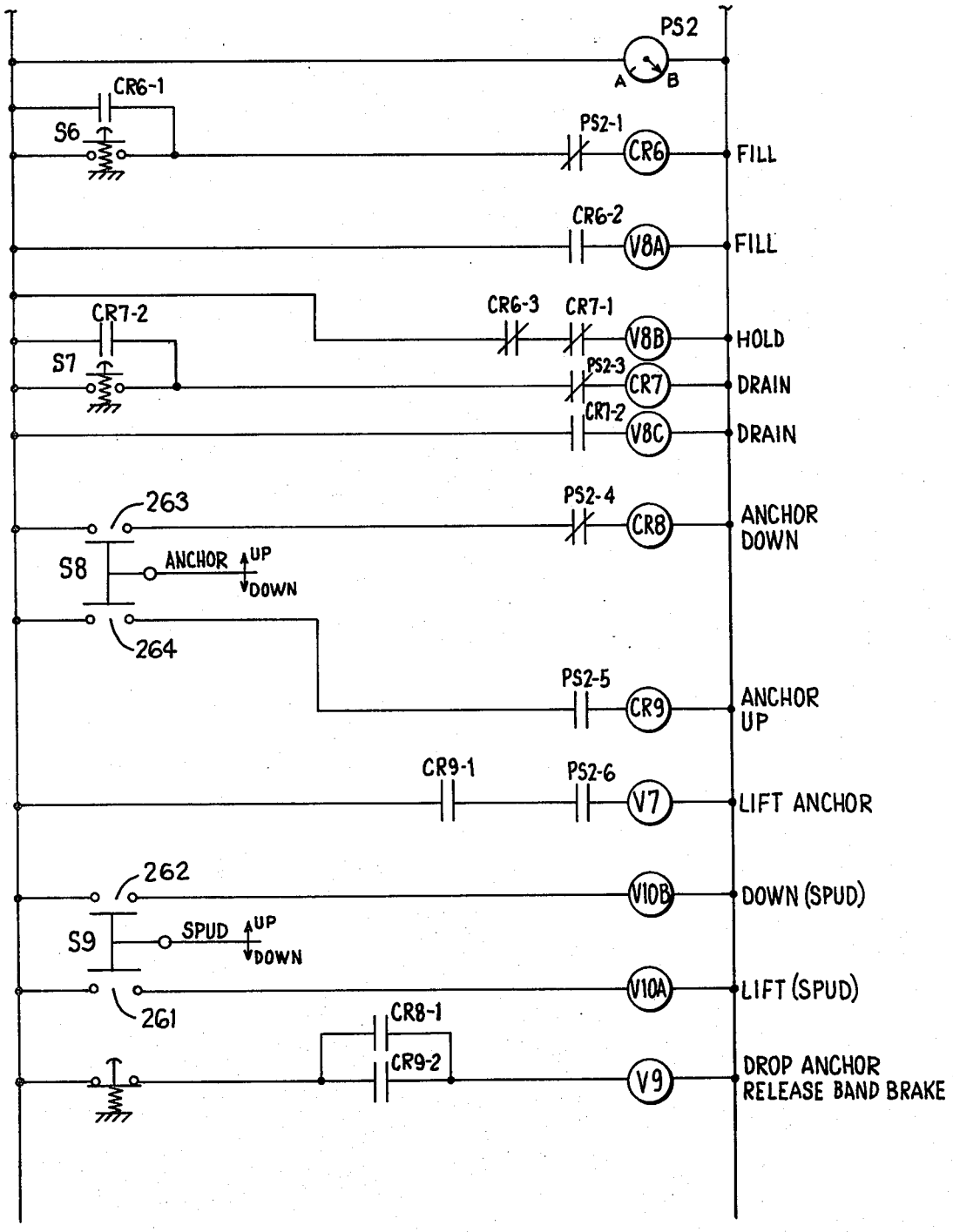
FIG. 12 is a control circuit for controlling the various components illustrated in FIG. 11.

While the schematic of FIG. 11 only shows one motor 55, it is to be understood that a pair of such motors exist for driving the swing winches 56A and 56B. Similarly, while only one drive motor 153 is illustrated in FIG. 12, it is to be understood that there are three such winch motors each effectively driving the power winches 146, 147 and 148. In addition, while there is only one power cylinder 39 illustrated in FIG. 12, it is to be understood that there are two such power cylinders 39 each effectively lifting one of the spuds 49A and 49B vertically upwardly on the aft end of the barge 10. While there are three chisels 136A, 136B and 136C, only one control circuit is shown for controlling one of the respective chisels. Similarly, while there are two position-maintaining spuds 49A and 49B, only one control circuit is shown for controlling the lifting and lowering thereof. While there are two anchors 82A and 82B, there is only one control illustrated in the schematic. It is to be understood that duplicate controls would be provided to accommodate the additional numbers of chisels, spuds and anchors. With these qualifications in mind, the operation of the various devices illustrated in FIG. 11 will now be set forth utilizing the electrical schematic illustrated in FIG. 12. Further, it is to be understood that the various valves described hereinabove are located in a valve room 247 located immediately below the control room 16.

The operator energizes the circuit illustrated in FIG. 12 by controlling a master switch MS so that electrical energy is applied to the electrical lines 248 and 249. It is assumed for purposes of this discussion that the chisels 136A, 136B and 136C are in the positions illustrated in FIG. 1, namely, with the tool bits 138A, 138B and 138C engaging the rock strata on the bottom of the body of water. Further, it is assumed that at least one of the position maintaining spuds 49A and 49B are in a position engaging the bottom of the body of water to effectively hold the barge in a fixed but pivotal position. It is additionally assumed that the anchors are appropriately positioned as illustrated in FIG. 2 to prevent wave action from displacing the barge beyond acceptable limits at the bow end 13 thereof and to control the pivotal movement of the hull about the axis of the lowered spud.

In order to raise the chisels 136A, 136B and 136C, it is necessary to first drain the interior cavity 222 of each of the drive motors 153. For purposes of this disclosure, it is assumed that the cavity 222 is now filled and at a pressure of about 35 to 40 psi. The pressure responsive switch PS1 is in the position B with each of its contacts PS1-1 to PS1-6 being in the condition as shown in FIG. 12. Thus, when it is desired to drain the interior cavity 222, the switch S2 will be closed to effect an energization of the control relay CR2. An energization of the control relay CR2 will effect a changing of its respective contacts, namely contacts CR2-1 through CR2-3. That is, the contact CR2-1 will open and the contact CR2-2 will close thereby energizing the C part of the valve V1 (schematically shown as valve V1C in FIG. 12) to shift the valve to position C to connect the hydraulic line 229 to the reservoir 179. The contact CR2-3 will become closed so that when the switch S2 is released by the operator, the control relay CR2 will remain in its energized condition. When the pressure responsive switch reaches position A indicating that the interior cavity 222 has been appropriately drained, each of its respective contacts PS1-1 through PS1-6 will be changed. For example, the contact PS1-2 will become closed to again energize the B part of valve V1 (schematically shown as valve V1B in FIG. 12) to shift the valve V1 to the B position wherein the hydraulic supply line 183 is connected to the reservoir 179. All of the conditions have now been satisfied to enable each of the chisels to be raised.

Since only one motor 153 has been shown in FIG. 11, only one switch S3 is shown in FIG. 12 even though in actuality there are three such identical switches. Only one such switch will be described in detail. The switch S3 is swung about the pivot 251 to the "up" position so that the contacts 252 thereof are closed. This will effect an energization of the control relay CR5 through the now closed set of contacts PS1-5. As a result, all of the contacts of the control relay CR5 will change their respective conditions. For example, the contact CR5-1 will become closed to maintain the valve V1B in the position B condition. The contact CR5-2 will open to prevent any shifting of the valve V1 to the position C due to an inadvertent closing of the switch S2. The contact CR5-3 will open to prevent any energization of the caliper braking mechanism 168. The contact CR5-4 and the contact CR5-5 will become closed to maintain energization of the control relay CR5 and to cause the valve V4 to supply hydraulic fluid to the rotor 224 of the motor 153 to effect a driving rotation of the stator 220. Since the stator 220 is connected to the shaft 154 on each of the power winches 146, 147 and 148, each drum 156 will be driven for rotation to effect a winding of the cable 175 thereon. If it is desired to stop the lifting operation of any one of the chisels, and emergency stop switch ES can be provided, if desired, in the circuit energizing the control relay CR5 to promptly effect a deenergization of same and a shifting of the valve V4 so that it no longer supplies fluid to the rotor 224.

The chisels will continue to be lifted until the limit switch LS is appropriately switched indicating that the chisels have been appropriately lifted so that the control relay CR4 will be energized by the blade 253 of the limit switch LS contacting the contact 254. Energization of the valve CR4 results in the contacts CR4-1 through CR4-3 thereof being changed. More specifically, the contacts CR4-3 will open to cause the valve V4 to halt the supply of hydraulic fluid to the rotor 224. Similarly, the contact CR4-1 will open so that the condition of the valve V2 will shift from position B to position A whereby the spring 233 will urge the piston 232 to a position to effect an application of the band brake mechanism 159 to hold the chisel in the raised position.

With each of the chisels in the lifted position, the operator can now cause same to free-fall from the lifted position back into engagement with the rock strata located on the bottom of the body of water to break the rock into small pieces. In order to accomplish this task, it is necessary to first fill the cavity 222 of each of the drive motors 153. This task is accomplished by closing the switch S1 to effect an energization of the control relay CR1 through the now-closed contacts PS1-1. Energization of the control relay CR1-1 will effect a changing of the condition of the respective contact CR1-1 and CR1-2 to a closed position so that the valve V1 is shifted to position A so that hydraulic fluid is supplied to the interior of the cavity 222. The pressure responsive switch, which is responsive to the fluid pressure in the cavity, will cause each of the contacts thereof PS1-1 through PS1-6 to change condition when the control member thereof reaches position B. At this point in time, the contact PS1-1 will open to deenergize the control relay CR1 and the contact PS1-2 will close to effect a shifting of the valve V1 to position B wherein hydraulic fluid in the line 183 is delivered to the reservoir 179. With the interior cavity now filled and at a pressure of 35 to 40 psi, the pressure therein is sufficient to drive each of the cam rollers 226 radially inwardly so that they no longer engage the undulating surface 223. At this point in time, the operator engages the control lever for the switch S3 and moves same to the "down" position so that the contacts 256 thereof become closed. This will effect an energization of the control relay CR3 thereby changing the state of its respective contacts CR3-1 and CR3-2. The contact CR3-1 will close to effect a changing of the positioning of the valve V2 to position B to supply hydraulic fluid to the side of the piston 232 remote from the spring 233 to thereby compress the spring and cause a release of the band brake mechanism 159. Simultaneously therewith, a delay timer DT is energized. The time period before the contact DT-1 of the delay timer becomes closed is determined by the operator. More specifically, as each chisel contacts the bottom of the body of water, the rotational momentum of each of the respective drums 156 will continue playing out cable 175 therefrom. The operator has a control in the control room 16 which enables him to control the time period of the delay timer so that the contact DT-1 can be appropriately closed to effect a changing of the condition of the valve V3 to effect an application of the caliper brake 168 to the caliper disk 157 of the drum 156 to prevent an undue amount of cable 175 from being dispensed from the drum 156 following impact of each chisel with the bottom of the body of water. The limit switch LS will again move back to engagement with the contact 257.

In order to lift the chisels again, the aforementioned procedure is repeated.

If the position of the mast 97 is to be altered, the switches S4A and S4B can be appropriately energized to shift the valve V5 to either supply fluid to the outlet A thereof or the outlet B thereof. It is to be noted that when undue shock loads are applied to the mast 97 by the release of the chisels for free fall or by the chisels engaging, for example, an inclined surface on the bottom of the body of water, the shock loads will be absorbed by the accumulators 201 and 202.

During the aforementioned operation, it has been assumed that the barge will maintain its position due to the engagement of at least one of the position maintaining spuds 49A and 49B with the bottom of the body of water as well as the anchors 82A and 82B maintaining their engaged position with the bottom. Should the seas become rough, load will be applied to the barge which will cause it to want to shift its position relative to the bottom. The operator in the control room can determine instantly whether the swing lines 81 are being properly stressed, or whether an over-stress condition is present and it would be prudent to quit working on the bottom of the body of water by pulling up the spuds and the respective anchors and moving into port. This determination can be made by reference to the pressure gauge 214. As a large wave hits the left or port side of the hull, for example, tension will be applied to the cable or swing line associated with the tensioning device 58B. The hull 11 will tend to move rightwardly thereby causing the piston 258 therein to move leftwardly (FIG. 11) to urge the pistons 212 in each of the accumulators 211 vertically upwardly to compress the gas in the upper portions thereof. This will also effect an increase in the pressure in the lower part of the accumulators 211 to cause the pressure gauge 214 to undergo an increase in its output reading. Once the indicator reaches a "red line" position 259, this will promptly tell the operator that the swing lines are being overly stressed and will shortly fail and that it would be best to pull up the spuds 49A and 49B as well as the anchors 82A and 82B and move into port as the seas are too rough.

In order to effect a pulling up of the spuds 49A and 49B, the switch S9 is moved so that it closes the contacts 261 so that the valve V10 (schematically shown as valve V10A) is energized to supply hydraulic fluid to the outlet A thereof. Fluid will thereby be supplied to the lower end of the piston in the cylinder 39 to raise the pulley housing 42 and thence each of the spuds 49A and 49B. In order to lower the spuds, the switch S9 is moved so that the contacts 262 will become closed so that the valve V10 is energized to supply fluid to the outlet B thereof.

In order to raise the anchors 82A and 82B, it is necessary to first drain the interior cavity 222 of each of the drive motors 55. This is accomplished by closing the switch S7 to effect an energization of the control relay CR7 through the closed contact PS2-3. An energization of the control relay CR7 will effect a closing of the contact CR7-2 to lock in the energization of the control relay CR7 as well as an opening of the contact CR7-1 and a closing of the contact CR7-2 to effect a shifting of the valve V8 to position C (schematically shown as valve V8C). This will connect the hydraulic line 231 to the reservoir 179. Once the pressure responsive switch PS2 reaches position A, each of its respective contacts PS2-1 through PS2-6 will change their respective state. The circuit is now in a proper condition for effecting a raising of each of the anchors.

Each anchor may be raised by moving the switch S8 to the "up" position thereby closing the contacts 264. A closing of the contacts 264 will effect an energization of the control relay CR9 and a resulting closing of the contacts CR9-1 thereof to effect an energization of the valve V7 through the now closed contact PS2-6. Energization of the valve V7 will supply hydraulic fluid to the rotor 222 thereby effecting a rotation of the stator 220 and the cable drum fixedly connected thereto. Moving of the switch S8 to the neutral position will stop the upward movement of a selected one or both of the anchors.

Since the tube 139 of each of the chisels is hollow, additional ballast can be added to the interior thereof to increase the effective weight of each of the chisels to improve its working capability on the bottom of the body of water. Generally, this ballast will include the filling of same with fresh water. Each of the chisels has an unballasted weight of 60,000 pounds. The addition of ballast to a majority of the interior of the tube 139 can result in an effective increase in the weight of the chisels to somewhere in the range of 90,000 to 100,000 pounds.

When it is desired to lower the anchors, the interior cavity 222 of each of the drive motors 55 must be filled. In order to accomplish this task, the switch S6 must be closed to effect an energization of the control relay CR6 through the now closed contact PS2-1. Energization of the control relay CR6 will cause a closing of the contact CR6-1 and a closing of the contact CR6-2 to effect a shifting of the valve V8 to position A (schematically shown as valve V8A in FIG. 12) so that hydraulic fluid from the pump P2 is supplied through the line 183 and line 229 to the interior cavity 222. Once the pressure responsive switch PS2 so indicates that the cavity is properly filled, all of the respective contacts thereof, namely, contacts PS2-1 and PS2-6 will change their state. The circuit is now in condition for effecting a dropping of the anchor. In this instance, the switch S8 is shifted so that the contacts 263 are closed to effect an energization of the control relay CR8. Energization of the control relay CR8 will effect a closing of the contact CR8-1 to energize the valve V9 causing it to shift from position A to position B whereby hydraulic fluid is supplied to the side of the piston 239 remote from the spring 241 to effect a release of the band brake mechanism 60. The weight of the anchor will cause cable 81 to be played out from the drum 57. This action will cause the anchor to freely move downwardly until it engages the bottom at which time the operator places the switch S8 in its neutral position where both of the contacts 263 and 264 are open and the band brake mechanism 60 is applied again.

Figure 16:
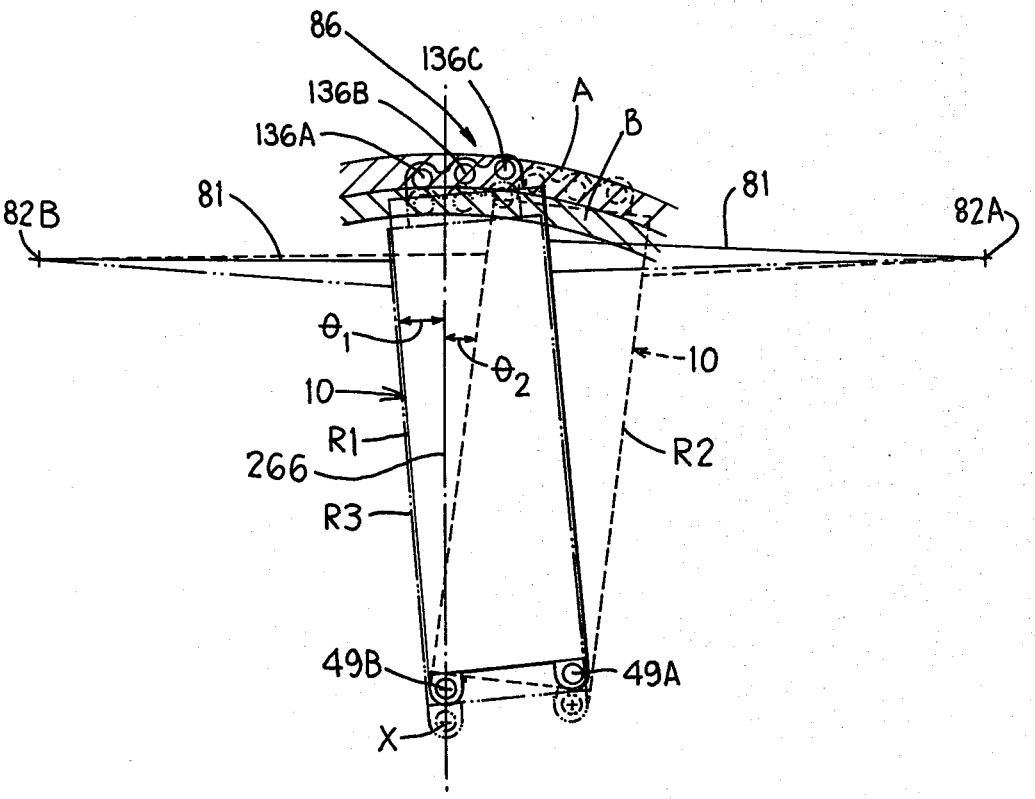
FIG. 16 is a view illustrating the manner in which the hull is manipulated to effect a thorough working of the bottom of the body of water.

FIG. 16 illustrates schematically the manner in which the position of the chisel barge 10 can be manipulated to virtually walk itself along the bottom of the body of water. For purposes of discussion, the spud 49B will be referred to as the working spud and the spud 49A will be referred to as the setting spud. By lowering the working spud 49B into engagement with the bottom of the body of water, the drum motor 55 to the cable drum connected to the anchor 82B is placed into a neutral position, that is, the interior cavity of the drive motor 55 is filled so that the cam rollers 226 are retracted away from the undulating surface of the stator 220. The drive motor 55 controlling the cable 81 to the anchor 82A is placed into a lift condition so that cable is wound onto the cable drum therefor. This will therefore cause the hull 11 to pivot clockwise from the position R1, wherein the lateral edges of the hull are at angle $\theta_1$ to the centerline 266 through the axis of the working spud 49B, about the upright axis of the working spud 49B to the dashed position R2 illustrated in FIG. 16. In this position, the lateral edges of the hull will be oriented at the angle $\theta_2$ to the centerline 266 through the axis of the working spud 49B. The setting spud 49A is then lowered into engagement with the bottom of the body of water and the working spud 49B raised. The drive motor 55 controlling the anchor 82A is placed into neutral and the drive motor 55 controlling the anchor 82B is placed into a lift condition to pull the hull 11 counterclockwise about the upright axis of the setting spud 49A until the axis of the working spud 49B reaches the position "X" on the centerline 266 at which time the operator places the drive motor controlling the anchor 82B into neutral while the working spud 49B is lowered into engagement with the bottom of the body of water and the setting spud 49A is raised. The hull 11 is now positioned at R3 behind the initial position R1 thereof shown in solid lines in FIG. 16. Thus, the first movement of the hull clockwise will work zone A of the bottom and the second clockwise motion of the hull with the working spud 49B in position "X" will work the bottom in the zone B. It will be clear to the reader that the sheave arrangements 74A and 74B must be pivotal in order to accommodate the varied positions of the cable or swing lines 81 as shown in dashed and chain-dotted lines in FIG. 16. The operator can, of course, adopt other modes of moving the hull back and forth about an upright axis of a selected one of the spuds depending upon the working conditions. This disclosure is not to be limited to the aforedescribed operational sequence of advancing the hull along the bottom of a body of water.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A chisel barge, comprising:

means defining an elongated hull floatable on a body of water;

position maintaining means maintaining the position of said hull means in a generally fixed location while in a floating condition spaced from land;

bracket means mounted on said hull, said bracket means having an opening therethrough, the axis of which is inclined to the horizontal;

pivot means pivotally supporting said bracket means on said hull for movement about a generally horizontal axis;

upstanding mast means mounted on said bracket means and tiltably movable therewith about said generally horizontal axis;

chisel means with tool means located at the lower end thereof vertically movably mounted on said mast means and in said opening; and control means for (1) effecting a hoisting of said chisel means to a raised position on said mast means spaced from the bottom of said body of water and (2) effecting a free fall of said chisel means to a lowered position impacting and effecting a working of the bottom of said body of water, said control means including shock absorbing means for normally maintaining said mast in an upright position and for effecting an absorption of any shock load generated by said chisel means that would cause a movement of said mast about said generally horizontal axis, said shock absorbing means further including a hydraulic cylinder having a reciprocal piston mounted therein, the opposite ends of said cylinder including coupling means hydraulically coupling said ends to separate accumulator means, each accumulator means having a movable partition means with a compressible gas on one said thereof and hydraulic fluid on the other side, said hydraulic fluid being coupled through said coupling means to the interior of said cylinder.

2. The chisel barge according to claim 1, wherein said generally horizontal axis of said pivot means intersects the axis of said opening in said bracket.

3. The chisel barge according to claim 2, wherein said mast means is positioned aft of said generally horizontal axis of said pivot means.

4. The chisel barge according to claim 1, wherein said mast means includes a further bracket means thereon intermediate the length thereof and having an opening therethrough, the axis of which is axially aligned with said opening in said first mentioned bracket means.

5. The chisel barge according to claim 4, wherein said chisel means includes at least one chisel comprising an elongated hollow cylinder with said tool means located at said lower end thereof, said hollow cylinder being guided by said openings in said bracket means and said further bracket means.

6. The chisel barge according to claim 5, wherein said elongated hollow cylinder is adapted to receive ballast therein for purposes of increasing the weight of said chisel.

7. The chisel barge according to claim 1, wherein said upstanding mast means and said chisel means are located at one end of said hull;

wherein said positioning maintaining means includes at least one elongated spud located at the other end of said hull and being supported on and adapted to extend downwardly from said hull into engagement with the bottom of said body of water, said hull being pivotal in said body of water about the axis of said spud when engaged with said bottom; and wherein said position maintaining means further includes an anchor on both the port and starboard sides of said hull adjacent said one end and anchor control means therefor to effect a controlled pivoting of said hull about said axis of said spud by controlling the relative closeness of said hull to a selected one of said anchors.

8. The chisel barge according to claim 7, wherein said positioning maintaining means includes a plural number of said spuds to thereby define plural axes about which said hull can pivot.

9. The chisel barge according to claim 8, wherein said plural number of said spuds is two.

10. The chisel barge according to claim 1, wherein one of said mast means and said bracket means includes gate means for facilitating access to the entire length of said chisel means from a side of said hull and a removal of said chisel means from said hull in a direction perpendicular to the longitudinal axis thereof.

* * * * *

UNITED STATES PATENT AND TRADEMARK OFFICE

CERTIFICATE OF CORRECTION

PATENT NO. : 4 473 256

DATED : September 25, 1984

INVENTOR(S) : James G. Collins

It is certified that error appears in the above-identified patent and that said Letters Patent is hereby corrected as shown below:

Column 17, line 49; change "said" to ---side---.

Signed and Sealed this

*Twelfth* Day of *March 1985*

[SEAL]

*Attest:*

DONALD J. QUIGG

*Attesting Officer* *Acting Commissioner of Patents and Trademarks*